US009928694B2

(12) United States Patent
Kisenwether et al.

(10) Patent No.: US 9,928,694 B2
(45) Date of Patent: Mar. 27, 2018

(54) GAMING MACHINE AND SYSTEM INCLUDING ADJUSTABLE USE OF GAME PERCENTAGE VARIANTS

(71) Applicant: BALLY GAMING, INC., Las Vegas, NV (US)

(72) Inventors: Joseph Kisenwether, Sparks, NV (US); Kenneth Shawn Soong, Henderson, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 27 days.

(21) Appl. No.: 15/248,987

(22) Filed: Aug. 26, 2016

(65) Prior Publication Data

US 2017/0061744 A1 Mar. 2, 2017

Related U.S. Application Data

(60) Provisional application No. 62/212,954, filed on Sep. 1, 2015.

(51) Int. Cl.

| | |
|---|---|
| ***A63F 9/00*** | (2006.01) |
| ***G07F 17/34*** | (2006.01) |
| ***G07F 17/32*** | (2006.01) |

(52) U.S. Cl.
CPC ..... *G07F 17/34* (2013.01); *G07F 17/3213* (2013.01); *G07F 17/3216* (2013.01); *G07F 17/3244* (2013.01)

(58) Field of Classification Search
None
See application file for complete search history.

(56) References Cited

U.S. PATENT DOCUMENTS

| | | | | |
|---|---|---|---|---|
| 9,773,378 | B2 * | 9/2017 | Louie | G07F 17/3258 |
| 2007/0167235 | A1 * | 7/2007 | Naicker | G07F 17/3244 463/42 |
| 2015/0087378 | A1 * | 3/2015 | Louie | G07F 17/3258 463/17 |

* cited by examiner

*Primary Examiner* — Seng H Lim
(74) *Attorney, Agent, or Firm* — Marvin A. Hein

(57) ABSTRACT

Disclosed are a gaming system, a regulated gaming machine and a method primarily dedicated for use in playing at least one regulated casino wagering game in which the gaming machine randomly determines which of a plurality of mathematical models of the casino wagering game to apply to a given play in order to achieve a selected game yield which may be different from the game yield of any one of the plurality of mathematical models defined for the casino wagering game.

20 Claims, 8 Drawing Sheets

| | Reel 1 | | Reel 2 | | Reel 3 | |
|---|---|---|---|---|---|---|
| Position | Symbol | Weight | Symbol | Weight | Symbol | Weight |
| | | 7 | | 8 | | 31 |
| 0 | | 31 | | 8 | | 7 |
| 1 | B2 | 7 | B1 | 1 | A2 | 7 |
| 2 | | 26 | | 37 | | 7 |
| 3 | B1 | 26 | B3 | 19 | CC | 7 |
| 4 | | 2 | | 1 | | 7 |
| 5 | WC | 2 | WC | 1 | A1 | 7 |
| 6 | | 2 | | 1 | | 7 |
| 7 | B2 | 26 | B3 | 19 | B1 | 7 |
| 8 | | 7 | | 37 | | 31 |
| 9 | A3 | 7 | B1 | 44 | B2 | 1 |
| 10 | | 7 | | 8 | | 1 |
| 11 | CC | 7 | A1 | 1 | A3 | 1 |
| 12 | | 7 | | 4 | | 4 |
| 13 | A2 | 7 | A1 | 11 | A3 | 4 |
| 14 | | 7 | | 8 | | 1 |
| 15 | A1 | 7 | A3 | 8 | WC | 1 |
| 16 | | 7 | | 8 | | 1 |
| 17 | B3 | 31 | CC | 8 | B2 | 31 |
| 18 | | 25 | | 8 | | 31 |
| 19 | B3 | 1 | B2 | 8 | B3 | 31 |
| 20 | | 7 | | 8 | | 31 |
| 21 | B1 | 7 | A2 | 8 | B1 | 31 |
| | | 31 | | 8 | | 7 |
| Total | | 256 | | 256 | | 256 |

FIG. 4A

| | Reel 1 | | Reel 2 | | Reel 3 | |
|---|---|---|---|---|---|---|
| Position | Symbol | Weight | Symbol | Weight | Symbol | Weight |
| | | 1 | | 7 | | 31 |
| 0 | | 29 | | 7 | | 5 |
| 1 | B2 | 1 | B1 | 46 | A2 | 5 |
| 2 | | 22 | | 40 | | 5 |
| 3 | B1 | 31 | B3 | 21 | CC | 5 |
| 4 | | 3 | | 2 | | 5 |
| 5 | WC | 3 | WC | 2 | A1 | 5 |
| 6 | | 3 | | 2 | | 5 |
| 7 | B2 | 31 | B3 | 21 | B1 | 8 |
| 8 | | 10 | | 40 | | 34 |
| 9 | A3 | 10 | B1 | 1 | B2 | 1 |
| 10 | | 10 | | 7 | | 1 |
| 11 | CC | 10 | A1 | 1 | A3 | 1 |
| 12 | | 10 | | 2 | | 3 |
| 13 | A2 | 10 | A1 | 8 | A3 | 3 |
| 14 | | 10 | | 7 | | 1 |
| 15 | A1 | 10 | A3 | 7 | WC | 1 |
| 16 | | 10 | | 7 | | 1 |
| 17 | B3 | 20 | CC | 7 | B2 | 34 |
| 18 | | 11 | | 7 | | 34 |
| 19 | B3 | 1 | B2 | 7 | B3 | 34 |
| 20 | | 10 | | 7 | | 34 |
| 21 | B1 | 1 | A2 | 7 | B1 | 31 |
| | | 29 | | 7 | | 5 |
| Total | | 256 | | 256 | | 256 |

FIG. 4B

| | Reel 1 | | Reel 2 | | Reel 3 | | Reel 4 | | Reel 5 | |
|---|---|---|---|---|---|---|---|---|---|---|
| Position | Symbol | Weight | Symbol | Weight | Symbol | Weight | Symbol | Weight | Symbol | Weight |
| | | 1 | | 1 | | 1 | | 1 | | 1 |
| 0 | FF | 1 | GG | 1 | GG | 1 | CC | 1 | FF | 1 |
| 1 | BB | 1 | JJ | 10 | CC | 6 | EE | 8 | DD | 1 |
| 2 | DD | 1 | FF | 10 | SF | 6 | BB | 8 | BB | 8 |
| 3 | FF | 12 | GG | 10 | GG | 6 | CC | 8 | JJ | 8 |
| 4 | JJ | 12 | JJ | 1 | CC | 1 | EE | 1 | DD | 8 |
| 5 | DD | 12 | DD | 1 | BB | 1 | SF | 1 | BB | 1 |
| 6 | FF | 1 | EE | 1 | HH | 1 | AA | 1 | FF | 1 |
| 7 | BB | 1 | JJ | 5 | JJ | 8 | GG | 1 | EE | 1 |
| 8 | DD | 1 | SF | 5 | AA | 8 | JJ | 2 | GG | 8 |
| 9 | GG | 1 | EE | 5 | HH | 8 | WC | 2 | HH | 8 |
| 10 | EE | 9 | JJ | 1 | JJ | 2 | GG | 2 | EE | 8 |
| 11 | HH | 9 | CC | 1 | WC | 2 | JJ | 1 | GG | 1 |
| 12 | GG | 9 | GG | 1 | HH | 2 | FF | 7 | FF | 2 |
| 13 | EE | 1 | HH | 1 | JJ | 1 | AA | 7 | BB | 2 |
| 14 | AA | 1 | EE | 6 | EE | 5 | JJ | 7 | GG | 2 |
| 15 | GG | 1 | BB | 6 | HH | 5 | FF | 1 | FF | 1 |
| 16 | CC | 1 | HH | 6 | JJ | 5 | AA | 1 | CC | 1 |
| 17 | FF | 1 | EE | 1 | EE | 1 | CC | 1 | FF | 8 |
| 18 | BB | 1 | FF | 1 | DD | 1 | FF | 1 | AA | 8 |
| 19 | CC | 1 | CC | 1 | SF | 1 | HH | 6 | DD | 8 |
| 20 | FF | 1 | GG | 1 | GG | 1 | SF | 6 | CC | 8 |
| 21 | JJ | 1 | HH | 2 | HH | 1 | FF | 6 | FF | 1 |
| 22 | DD | 1 | DD | 2 | BB | 4 | HH | 1 | AA | 1 |
| 23 | AA | 3 | GG | 2 | DD | 4 | GG | 1 | CC | 1 |
| 24 | HH | 3 | HH | 1 | HH | 4 | BB | 2 | JJ | 1 |
| 25 | GG | 3 | JJ | 1 | BB | 1 | DD | 2 | AA | 1 |
| 26 | DD | 3 | WC | 1 | DD | 1 | GG | 2 | CC | 1 |
| 27 | AA | 1 | HH | 1 | GG | 1 | BB | 1 | | 1 |
| 28 | FF | 1 | JJ | 1 | FF | 3 | CC | 1 | | |
| 29 | BB | 1 | CC | 1 | DD | 3 | GG | 1 | | |
| 30 | EE | 1 | FF | 4 | GG | 3 | DD | 3 | | |
| 31 | CC | 1 | AA | 4 | FF | 1 | EE | 3 | | |
| 32 | DD | 1 | CC | 4 | HH | 1 | GG | 3 | | |
| 33 | EE | 1 | FF | 1 | JJ | 1 | DD | 1 | | |
| 34 | CC | 1 | | 1 | | 1 | | 1 | | |
| | | 1 | | | | | | | | |
| Total | | 100 | | 100 | | 100 | | 100 | | 100 |

FIG. 5A

| | Reel 1 | | Reel 2 | | Reel 3 | | Reel 4 | | Reel 5 | |
|---|---|---|---|---|---|---|---|---|---|---|
| Position | Symbol | Weight | Symbol | Weight | Symbol | Weight | Symbol | Weight | Symbol | Weight |
| | | 1 | | 1 | | 1 | | 1 | | 1 |
| 0 | FF | 1 | GG | 1 | GG | 1 | CC | 1 | FF | 1 |
| 1 | BB | 1 | JJ | 10 | CC | 6 | EE | 8 | DD | 1 |
| 2 | DD | 1 | FF | 10 | SF | 6 | BB | 8 | BB | 8 |
| 3 | FF | 12 | GG | 10 | GG | 6 | CC | 8 | JJ | 8 |
| 4 | JJ | 12 | JJ | 1 | CC | 1 | EE | 1 | DD | 8 |
| 5 | DD | 12 | DD | 1 | BB | 1 | SF | 1 | BB | 1 |
| 6 | FF | 1 | EE | 1 | HH | 1 | AA | 1 | FF | 1 |
| 7 | BB | 1 | JJ | 5 | JJ | 8 | GG | 1 | EE | 1 |
| 8 | AA | 1 | SF | 5 | AA | 8 | JJ | 2 | GG | 8 |
| 9 | GG | 1 | EE | 5 | HH | 8 | WC | 2 | HH | 8 |
| 10 | EE | 9 | JJ | 1 | JJ | 2 | GG | 2 | EE | 8 |
| 11 | HH | 9 | CC | 1 | WC | 2 | JJ | 1 | GG | 1 |
| 12 | GG | 9 | GG | 1 | HH | 2 | FF | 7 | FF | 2 |
| 13 | EE | 1 | HH | 1 | JJ | 1 | AA | 7 | BB | 2 |
| 14 | AA | 1 | EE | 6 | EE | 5 | JJ | 7 | GG | 2 |
| 15 | GG | 1 | BB | 6 | FF | 5 | FF | 1 | FF | 1 |
| 16 | CC | 1 | HH | 6 | JJ | 5 | AA | 1 | CC | 1 |
| 17 | EE | 1 | EE | 1 | EE | 1 | CC | 1 | FF | 8 |
| 18 | BB | 1 | FF | 1 | FF | 1 | DD | 1 | AA | 8 |
| 19 | CC | 1 | CC | 1 | SF | 1 | HH | 6 | DD | 8 |
| 20 | FF | 1 | GG | 1 | GG | 1 | SF | 6 | CC | 8 |
| 21 | BB | 1 | HH | 2 | EE | 1 | DD | 6 | FF | 1 |
| 22 | DD | 1 | DD | 2 | BB | 4 | HH | 1 | AA | 1 |
| 23 | AA | 3 | GG | 2 | DD | 4 | GG | 1 | CC | 1 |
| 24 | HH | 3 | HH | 1 | EE | 4 | BB | 2 | JJ | 1 |
| 25 | GG | 3 | DD | 1 | BB | 1 | DD | 2 | AA | 1 |
| 26 | DD | 3 | WC | 1 | DD | 1 | GG | 2 | CC | 1 |
| 27 | AA | 1 | HH | 1 | GG | 1 | BB | 1 | | 1 |
| 28 | FF | 1 | DD | 1 | FF | 3 | CC | 1 | | |
| 29 | BB | 1 | CC | 1 | DD | 3 | GG | 1 | | |
| 30 | EE | 1 | FF | 4 | GG | 3 | DD | 3 | | |
| 31 | CC | 1 | AA | 4 | FF | 1 | EE | 3 | | |
| 32 | AA | 1 | CC | 4 | EE | 1 | GG | 3 | | |
| 33 | EE | 1 | FF | 1 | BB | 1 | DD | 1 | | |
| 34 | CC | 1 | | 1 | | 1 | | 1 | | |
| | | 1 | | | | | | | | |
| Total | | 100 | | 100 | | 100 | | 100 | | 100 |

FIG. 5B

| Bonus Wheel Outcomes | | | | | |
|---|---|---|---|---|---|
| Position | Award Description | Value | Weight | Prob | EV |
| 0 | Credits | 10 | 28,000 | 0.0277 | 0.28 |
| 1 | Credits | 1,000 | 86 | 0.0001 | 0.08 |
| 2 | Credits | 7 | 17,000 | 0.0168 | 0.12 |
| 3 | Credits | 25 | 30,000 | 0.0296 | 0.74 |
| 4 | Credits | 9 | 20,000 | 0.0198 | 0.18 |
| 5 | Credits | 20 | 32,000 | 0.0316 | 0.63 |
| 6 | FREE GAMES 2 | 30.83 | 113,906 | 0.1125 | 3.47 |
| 7 | Credits | 18 | 32,000 | 0.0316 | 0.57 |
| 8 | Credits | 40 | 24,204 | 0.0239 | 0.96 |
| 9 | Credits | 15 | 30,000 | 0.0296 | 0.44 |
| 10 | FREE GAMES 1 | 30.85 | 113,906 | 0.1125 | 3.47 |
| 11 | Credits | 10 | 23,000 | 0.0227 | 0.23 |
| 12 | Credits | 35 | 19,000 | 0.0188 | 0.66 |
| 13 | Credits | 18 | 32,000 | 0.0316 | 0.57 |
| 14 | Credits | 7 | 17,000 | 0.0168 | 0.12 |
| 15 | Credits | 1,000 | 86 | 0.0001 | 0.08 |
| 16 | Credits | 5 | 20,500 | 0.0202 | 0.10 |
| 17 | Credits | 25 | 28,000 | 0.0277 | 0.69 |
| 18 | Credits | 12 | 28,000 | 0.0277 | 0.33 |
| 19 | Credits | 30 | 24,000 | 0.0237 | 0.71 |
| 20 | FREE GAMES 2 | 30.83 | 113,906 | 0.1125 | 3.47 |
| 21 | Credits | 9 | 23,000 | 0.0227 | 0.20 |
| 22 | Credits | 35 | 18,000 | 0.0178 | 0.62 |
| 23 | Credits | 12 | 27,000 | 0.0267 | 0.32 |
| 24 | FREE GAMES 1 | 30.85 | 113,906 | 0.1125 | 3.47 |
| 25 | Credits | 30 | 22,000 | 0.0217 | 0.65 |
| 26 | Credits | 15 | 30,000 | 0.0296 | 0.44 |
| 27 | Credits | 20 | 32,000 | 0.0316 | 0.63 |
| Total | | | 1,012,500 | 1.0000 | 24.24 |

FIG. 6A

| Bonus Wheel Outcomes | | | | | |
|---|---|---|---|---|---|
| Position | Award Description | Value | Weight | Prob | EV |
| 0 | Credits | 10 | 28,000 | 0.0277 | 0.28 |
| 1 | Credits | 1,000 | 5,000 | 0.0049 | 4.94 |
| 2 | Credits | 7 | 15,000 | 0.0148 | 0.10 |
| 3 | Credits | 25 | 30,000 | 0.0296 | 0.74 |
| 4 | Credits | 9 | 20,000 | 0.0198 | 0.18 |
| 5 | Credits | 20 | 33,000 | 0.0326 | 0.65 |
| 6 | FREE GAMES 2 | 30.83 | 113,906 | 0.1125 | 3.47 |
| 7 | Credits | 18 | 32,000 | 0.0316 | 0.57 |
| 8 | Credits | 40 | 25,204 | 0.0249 | 1.00 |
| 9 | Credits | 15 | 30,000 | 0.0296 | 0.44 |
| 10 | FREE GAMES 1 | 30.85 | 113,906 | 0.1125 | 3.47 |
| 11 | Credits | 10 | 23,000 | 0.0227 | 0.23 |
| 12 | Credits | 35 | 19,000 | 0.0188 | 0.66 |
| 13 | Credits | 18 | 32,672 | 0.0323 | 0.58 |
| 14 | Credits | 7 | 15,000 | 0.0148 | 0.10 |
| 15 | Credits | 1,000 | 5,000 | 0.0049 | 4.94 |
| 16 | Credits | 5 | 12,000 | 0.0119 | 0.06 |
| 17 | Credits | 25 | 28,000 | 0.0277 | 0.69 |
| 18 | Credits | 12 | 28,000 | 0.0277 | 0.33 |
| 19 | Credits | 30 | 24,000 | 0.0237 | 0.71 |
| 20 | FREE GAMES 2 | 30.83 | 113,906 | 0.1125 | 3.47 |
| 21 | Credits | 9 | 23,000 | 0.0227 | 0.20 |
| 22 | Credits | 35 | 18,000 | 0.0178 | 0.62 |
| 23 | Credits | 12 | 27,000 | 0.0267 | 0.32 |
| 24 | FREE GAMES 1 | 30.85 | 113,906 | 0.1125 | 3.47 |
| 25 | Credits | 30 | 22,000 | 0.0217 | 0.65 |
| 26 | Credits | 15 | 30,000 | 0.0296 | 0.44 |
| 27 | Credits | 20 | 32,000 | 0.0316 | 0.63 |
| Total | | | 1,012,500 | 1.0000 | 33.95 |

FIG. 6B

GAMING MACHINE AND SYSTEM INCLUDING ADJUSTABLE USE OF GAME PERCENTAGE VARIANTS

RELATED APPLICATIONS

This application is a non-provisional application of U.S. Provisional Application 62/212,954 filed on Sep. 1, 2015, hereby incorporated by reference in its entirety for all purposes.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, systems, apparatus, and methods and, more particularly, to gaming machines, systems, apparatus, and methods including adjustable game percentage variants.

BACKGROUND OF THE INVENTION

The gaming industry depends upon player participation. Players are generally "hopeful" players who either think they are lucky or at least think they can get lucky—for a relatively small investment to play a game, they can get a disproportionately large return. To create this feeling of luck, a gaming apparatus relies upon an internal or external random element generator to generate one or more random elements such as random numbers. The gaming apparatus determines a game outcome based, at least in part, on the one or more random elements.

A significant technical challenge is to improve the operation of gaming apparatus and games played thereon, including the manner in which they leverage the underlying random element generator, by making them yield a negative return on investment in the long run (via a high quantity and/or frequency of player/apparatus interactions) and yet random and volatile enough to make players feel they can get lucky and win in the short run. Striking the right balance between yield versus randomness and volatility to create a feeling of luck involves addressing many technical problems, some of which can be at odds with one another. This luck factor is what appeals to core players and encourages prolonged and frequent player participation. Traditionally, an operator of a gaming machine, such as a casino or other gaming establishment, is provided the opportunity to adjust the yield of the game provided by the gaming machine either by installing a different software variation or by selecting one of a predefined set of yields provided by the manufacturer of the gaming machine. Greater flexibility to fine-tune such adjustments is desirable and, as the industry matures, the creativity and ingenuity required to improve such operation of gaming apparatus and games grows accordingly.

SUMMARY OF THE INVENTION

According to one aspect of the present invention, a gaming system includes a regulated gaming machine primarily dedicated for use in playing at least one regulated casino wagering game, the gaming machine including an electronic display device, one or more electronic input devices, a value input device and game-logic circuitry configured to provide a low variant mathematical model of the casino wagering game providing a first yield percentage and a high variant mathematical model of the casino wagering game providing a second yield percentage greater than the first yield percentage. The game logic circuitry is also configured to accept an input indicative of a desired yield percentage between the first yield percentage and the second yield percentage, inclusive. The game logic circuitry is further configured to, based on the first yield percentage, the second yield percentage and the desired yield percentage, compute relative probabilities of selecting the low variant mathematical model and the high variant mathematical model for a given play of the casino wagering game and generate a weighted table based on the relative probabilities; to detect, via the value input device, a physical item associated with a monetary value that establishes a credit balance, to receive an input indicative of a wager covered by the credit balance; to randomly select an entry from the weighted table to determine whether the low variant mathematical model or the high variant mathematical model will be used for the current play of the casino wagering game; to randomly select an outcome of the casino wagering game based in part on the determined mathematical model; to direct the electronic display device to display the selected outcome; to award an award in response to the displayed outcome meeting a predetermined award criterion; and to receive, via at least one of the one or more electronic input devices, a cashout input that initiates a payout from the credit balance.

According to other embodiments of the present invention, a regulated gaming machine primarily dedicated for use in playing at least one regulated casino wagering game includes an electronic display device, one or more electronic input devices, a value input device and game-logic circuitry configured to provide a low variant mathematical model of the casino wagering game providing a first yield percentage and a high variant mathematical model of the casino wagering game providing a second yield percentage greater than the first yield percentage and accept an input indicative of a desired yield percentage between the first yield percentage and the second yield percentage, inclusive. The game logic circuitry is also configured to, based on the first yield percentage, the second yield percentage and the desired yield percentage, compute relative probabilities of selecting the low variant mathematical model and the high variant mathematical model for a given play of the casino wagering game and generate a weighted table based on the relative probabilities; to detect, via the value input device, a physical item associated with a monetary value that establishes a credit balance; to receive an input indicative of a wager covered by the credit balance; to randomly select an entry from the weighted table to determine whether the low variant mathematical model or the high variant mathematical model will be used for the current play of the casino wagering game; to randomly select an outcome of the casino wagering game based in part on the determined mathematical model; to direct the electronic display device to display the selected outcome; to award an award in response to the displayed outcome meeting a predetermined award criterion; and to receive, via at least one of the one or more electronic input devices, a cashout input that initiates a payout from the credit balance.

In accordance with one or more embodiments, a method of operating a gaming system including a regulated gaming machine primarily dedicated for use in playing at least one regulated casino wagering game, the gaming machine including an electronic display device, one or more electronic input devices, a value input device comprises the steps of providing a low variant mathematical model of the casino wagering game providing a first yield percentage and a high variant mathematical model of the casino wagering game providing a second yield percentage greater than the first yield percentage. The method also includes the steps of accepting an input indicative of a desired yield percentage between the first yield percentage and the second yield percentage, inclusive. The method further, based on the first yield percentage, the second yield percentage and the desired yield percentage, computes relative probabilities of selecting the low variant mathematical model and the high variant mathematical model for a given play of the casino wagering game and generates a weighted table based on the relative probabilities. The method also detects, via the value input device, a physical item associated with a monetary value that establishes a credit balance; receives an input indicative of a wager covered by the credit balance; randomly selects an entry from the weighted table to determine whether the low variant mathematical model or the high variant mathematical model will be used for the current play of the casino wagering game; randomly selects an outcome of the casino wagering game based in part on the determined mathematical model; directs the electronic display device to display the selected outcome; to award an award in response to the displayed outcome meeting a predetermined award criterion; and receives, via at least one of the one or more electronic input devices, a cashout input that initiates a payout from the credit balance.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

FIGS. 4A and 4B illustrate two examples of reel layouts according to an embodiment of the present invention.

FIGS. 5A and 5B illustrate two examples of reel layouts according to another embodiment of the present invention.

FIGS. 6A and 6B illustrate two examples of feature wheel weights according to another embodiment of the present invention.

DETAILED DESCRIPTION

Figure 1:
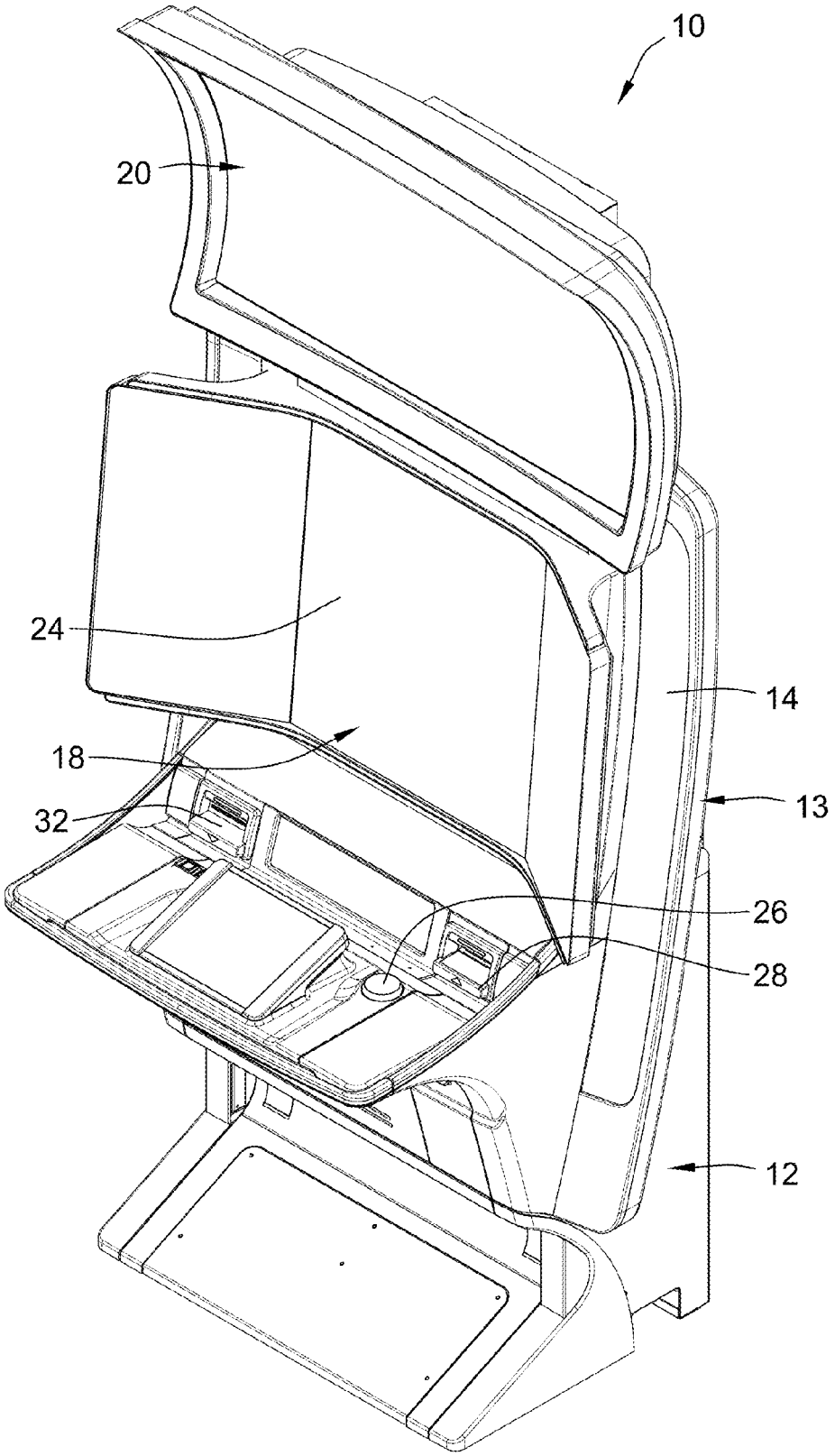
FIG. 1 is a perspective view of a free-standing gaming machine according to an embodiment of the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering game," "casino wagering game," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game may be subject to approval for use in one of more regulated gaming jurisdictions. In some embodiments, the wagering game involves wagers of real money, as found with typical land-based or online casino games. In other embodiments, the wagering game additionally, or alternatively, involves wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Referring to FIG. 1, there is shown a gaming machine 10 similar to those operated in gaming establishments, such as casinos. With regard to the present invention, the gaming machine 10 may be any type of gaming terminal or machine and may have varying structures and methods of operation. For example, in some aspects, the gaming machine 10 is an electromechanical gaming terminal configured to play mechanical slots, whereas in other aspects, the gaming machine is an electronic gaming terminal configured to play a video casino game, such as slots, keno, poker, blackjack, roulette, craps, etc. The gaming machine 10 may take any suitable form, such as floor-standing models as shown, handheld mobile units, bartop models, workstation-type console models, etc. Further, the gaming machine 10 may be primarily dedicated for use in playing wagering games, or may include non-dedicated devices, such as mobile phones, personal digital assistants, personal computers, etc. Exemplary types of gaming machines are disclosed in U.S. Pat. Nos. 6,517,433, 8,057,303, and 8,226,459, which are incorporated herein by reference in their entireties.

The gaming machine 10 illustrated in FIG. 1 comprises a gaming cabinet 12 that securely houses various input devices, output devices, input/output devices, internal electronic/electromechanical components, and wiring. The cabinet 12 includes exterior walls, interior walls and shelves for mounting the internal components and managing the wiring, and one or more front doors that are locked and require a physical or electronic key to gain access to the interior compartment of the cabinet 12 behind the locked door. The cabinet 12 optionally forms an alcove configured to store one or more beverages or personal items of a player. A notification mechanism, such as a candle or tower light, is optionally mounted to the top of the cabinet 12. It flashes to alert an attendant that change is needed, a hand pay is requested, or there is a potential problem with the gaming machine 10. The gaming cabinet 12 optionally includes a rear wing 13 having a front surface 14 that is positioned rearward of a primary display 18.

The input devices, output devices, and input/output devices are disposed on, and securely coupled to, the cabinet 12. By way of example, the output devices include the primary display 18, a secondary display 20, and one or more audio speakers. The primary display 18 or the secondary display 20 may be a mechanical-reel display device, a video display device, or a combination thereof in which a transmissive video display is disposed in front of the mechanical-reel display to portray a video image superimposed upon the mechanical-reel display. The displays variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming machine 10. The gaming machine 10 includes a touch screen(s) 24 mounted over the primary or secondary displays, one or more buttons 26 on a button panel and/or other player-input devices, a bill/ticket acceptor 28, a card reader/writer and/or ticket dispenser 32, and player-accessible ports (e.g., audio output jack for headphones, video headset jack, USB port, wireless transmitter/receiver, etc.). It should be understood that numerous other peripheral devices and other elements exist and are readily utilizable in any number of combinations to create various forms of a gaming machine in accord with the present concepts.

The player input devices, such as the touch screen 24, buttons 26, a mouse, a joystick, a gesture-sensing device, a voice-recognition device, and a virtual-input device, accept player inputs and transform the player inputs to electronic data signals indicative of the player inputs, which correspond to an enabled feature for such inputs at a time of activation (e.g., pressing a "Max Bet" button or soft key to indicate a player's desire to place a maximum wager to play the wagering game). The inputs, once transformed into electronic data signals, are output to game-logic circuitry for processing. The electronic data signals are selected from a group consisting essentially of an electrical current, an electrical voltage, an electrical charge, an optical signal, an optical element, a magnetic signal, and a magnetic element.

The gaming machine 10 includes one or more value input/payment devices and value output/payout devices. The value input devices are used to deposit cash or credits onto the gaming machine 10. The cash or credits are used to fund wagers placed on the wagering game played via the gaming machine 10. Examples of value input devices include, but are not limited to, a coin acceptor, the bill/ticket acceptor 28, the card reader/writer 30, a wireless communication interface for reading cash or credit data from a nearby mobile device, and a network interface for withdrawing cash or credits from a remote account via an electronic funds transfer. A value input device is configured to detect a physical item, such as coins, currency, cards, etc., associated with a monetary value that establishes a credit balance on a credit meter such as the "credits" meter 84 (see FIG. 3). In response to a cashout input that initiates a payout from the credit balance on the "credits" meter 84, the value output devices are used to dispense cash or credits from the gaming machine 10. The credits may be exchanged for cash at, for example, a cashier or redemption station. Examples of value output devices include, but are not limited to, a coin hopper for dispensing coins or tokens, a bill dispenser, the card reader/writer 30, the ticket dispenser 32 for printing tickets redeemable for cash or credits, a wireless communication interface for transmitting cash or credit data to a nearby mobile device, and a network interface for depositing cash or credits to a remote account via an electronic funds transfer.

Figure 2:
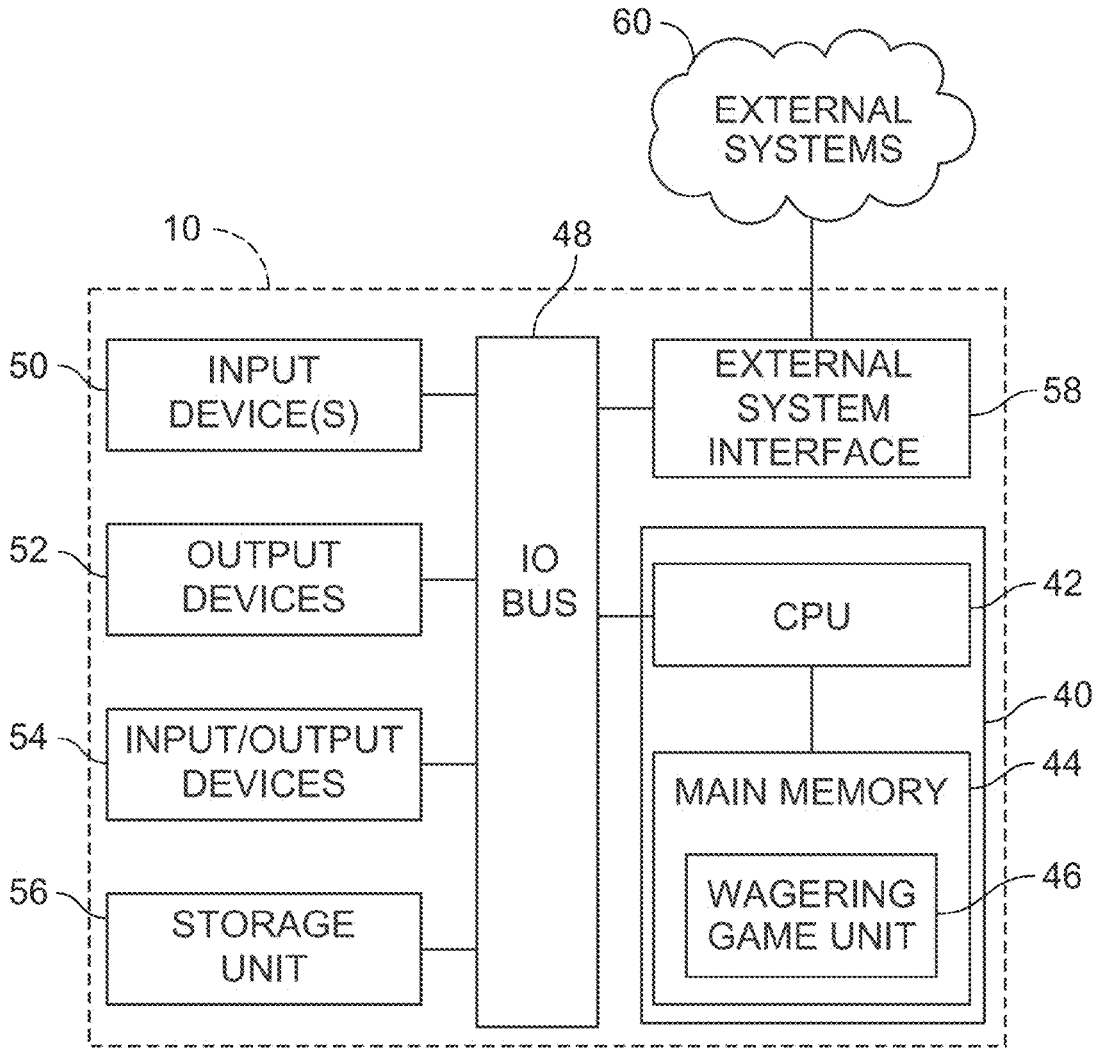
FIG. 2 is a schematic view of a gaming system according to an embodiment of the present invention.

Turning now to FIG. 2, there is shown a block diagram of the gaming-machine architecture. The gaming machine 10 includes game-logic circuitry 40 securely housed within a locked box inside the gaming cabinet 12 (see FIG. 1). The game-logic circuitry 40 includes a central processing unit (CPU) 42 connected to a main memory 44 that comprises one or more memory devices. The CPU 42 includes any suitable processor(s), such as those made by Intel and AMD. By way of example, the CPU 42 includes a plurality of microprocessors including a master processor, a slave processor, and a secondary or parallel processor. Game-logic circuitry 40, as used herein, comprises any combination of hardware, software, or firmware disposed in or outside of the gaming machine 10 that is configured to communicate with or control the transfer of data between the gaming machine 10 and a bus, another computer, processor, device, service, or network. The game-logic circuitry 40, and more specifically the CPU 42, comprises one or more controllers or processors and such one or more controllers or processors need not be disposed proximal to one another and may be located in different devices or in different locations. The game-logic circuitry 40, and more specifically the main memory 44, comprises one or more memory devices which need not be disposed proximal to one another and may be located in different devices or in different locations. The game-logic circuitry 40 is operable to execute all of the various gaming methods and other processes disclosed herein. The main memory 44 includes a wagering-game unit 46. In one embodiment, the wagering-game unit 46 causes wagering games to be presented, such as video poker, video black jack, video slots, video lottery, etc., in whole or part.

The game-logic circuitry 40 is also connected to an input/output (I/O) bus 48, which can include any suitable bus technologies, such as an AGTL+frontside bus and a PCI backside bus. The I/O bus 48 is connected to various input devices 50, output devices 52, and input/output devices 54 such as those discussed above in connection with FIG. 1. The I/O bus 48 is also connected to a storage unit 56 and an external-system interface 58, which is connected to external system(s) 60 (e.g., wagering-game networks).

The external system 60 includes, in various aspects, a gaming network, other gaming machines or terminals, a gaming server, a remote controller, communications hardware, or a variety of other interfaced systems or components, in any combination. In yet other aspects, the external system 60 comprises a player's portable electronic device (e.g., cellular phone, electronic wallet, etc.) and the external-system interface 58 is configured to facilitate wireless communication and data transfer between the portable electronic device and the gaming machine 10, such as by a near-field communication path operating via magnetic-field induction or a frequency-hopping spread spectrum RF signals (e.g., Bluetooth, etc.).

The gaming machine 10 optionally communicates with the external system 60 such that the gaming machine 10 operates as a thin, thick, or intermediate client. The game-logic circuitry 40—whether located within ("thick client"), external to ("thin client"), or distributed both within and external to ("intermediate client") the gaming machine 10—is utilized to provide a wagering game on the gaming machine 10. In general, the main memory 44 stores programming for a random number generator (RNG), game-outcome logic, and game assets (e.g., art, sound, etc.)—all of which obtained regulatory approval from a gaming control board or commission and are verified by a trusted authentication program in the main memory 44 prior to game execution. The authentication program generates a live authentication code (e.g., digital signature or hash) from the memory contents and compare it to a trusted code stored in the main memory 44. If the codes match, authentication is deemed a success and the game is permitted to execute. If, however, the codes do not match, authentication is deemed a failure that must be corrected prior to game execution. Without this predictable and repeatable authentication, the gaming machine 10, external system 60, or both are not allowed to perform or execute the RNG programming or game-outcome logic in a regulatory-approved manner and are therefore unacceptable for commercial use. In other words, through the use of the authentication program, the game-logic circuitry facilitates operation of the game in a way that a person making calculations or computations could not.

When a wagering-game instance is executed, the CPU 42 (comprising one or more processors or controllers) executes the RNG programming to generate one or more pseudo-random numbers. The pseudo-random numbers are divided into different ranges, and each range is associated with a respective game outcome. Accordingly, the pseudo-random numbers are utilized by the CPU 42 when executing the game-outcome logic to determine a resultant outcome for that instance of the wagering game. The resultant outcome is then presented to a player of the gaming machine 10 by accessing the associated game assets, required for the resultant outcome, from the main memory 44. The CPU 42 causes the game assets to be presented to the player as outputs from the gaming machine 10 (e.g., audio and video presentations). Instead of a pseudo-RNG, the game outcome may be derived from random numbers generated by a physical RNG that measures some physical phenomenon that is expected to be random and then compensates for possible biases in the measurement process. Whether the RNG is a pseudo-RNG or physical RNG, the RNG uses a seeding process that relies upon an unpredictable factor (e.g., human interaction of turning a key) and cycles continuously in the background between games and during game play at a speed that cannot be timed by the player, for example, at a minimum of 100 Hz (100 calls per second) as set forth in Nevada's New Gaming Device Submission Package. Accordingly, the RNG cannot be carried out manually by a human and is integral to operating the game. For purposes of the present detailed description, the term "randomly determine" or "randomly select" is intended to include the use of either a pseudo-RNG or physical RNG in the determination of a value, outcome or element.

The gaming machine 10 may be used to play central determination games, such as electronic pull-tab and bingo games. In an electronic pull-tab game, the RNG is used to randomize the distribution of outcomes in a pool and/or to select which outcome is drawn from the pool of outcomes when the player requests to play the game. In an electronic bingo game, the RNG is used to randomly draw numbers that players match against numbers printed on their electronic bingo card.

The gaming machine 10 may include additional peripheral devices or more than one of each component shown in FIG. 2. Any component of the gaming-machine architecture includes hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic-disk storage media, optical storage media, flash memory, etc.

Figure 3:
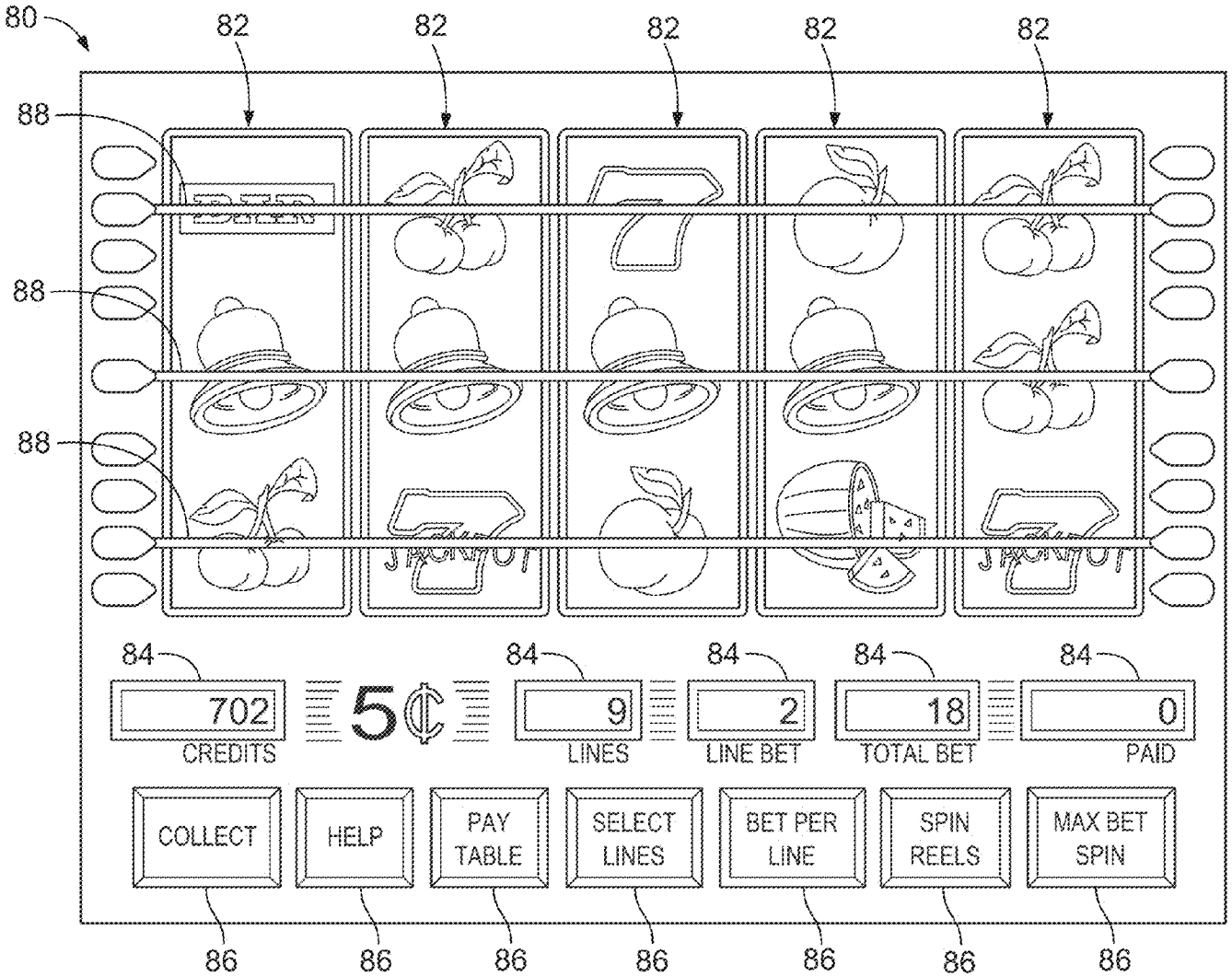
FIG. 3 is an image of an exemplary basic-game screen of a wagering game displayed on a gaming machine, according to an embodiment of the present invention.

Referring now to FIG. 3, there is illustrated an image of a basic-game screen 80 adapted to be displayed on the primary display 18 or the secondary display 20. The basic-game screen 80 portrays a plurality of simulated symbol-bearing reels 82. Alternatively or additionally, the basic-game screen 80 portrays a plurality of mechanical reels or other video or mechanical presentation consistent with the game format and theme. The basic-game screen 80 also advantageously displays one or more game-session credit meters 84 and various touch screen buttons 86 adapted to be actuated by a player. A player can operate or interact with the wagering game using these touch screen buttons or other input devices such as the buttons 26 shown in FIG. 1. The game-logic circuitry 40 operates to execute a wagering-game program causing the primary display 18 or the secondary display 20 to display the wagering game.

In response to receiving an input indicative of a wager covered by the credit balance on the "credits" meter 84, the reels 82 are rotated and stopped to place symbols on the reels in visual association with paylines such as paylines 88. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering-game outcome is provided or displayed in response to the wager being received or detected. The wagering-game outcome, for that particular wagering-game instance, is then revealed to the player in due course following initiation of the wagering game. The method comprises the acts of conducting the wagering game using a gaming apparatus, such as the gaming machine 10 depicted in FIG. 1, following receipt of an input from the player to initiate a wagering-game instance. The gaming machine 10 then communicates the wagering-game outcome to the player via one or more output devices (e.g., primary display 18 or secondary display 20) through the display of information such as, but not limited to, text, graphics, static images, moving images, etc., or any combination thereof. In accord with the method of conducting the wagering game, the game-logic circuitry 40 transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the game-logic circuitry 40 is configured to process the electronic data signal, to interpret the data signal (e.g., data signals corresponding to a wager input), and to cause further actions associated with the interpretation of the signal in accord with stored instructions relating to such further actions executed by the controller. As one example, the CPU 42 causes the recording of a digital representation of the wager in one or more storage media (e.g., storage unit 56), the CPU 42, in accord with associated stored instructions, causes the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM, etc.). The noted second state of the data storage media comprises storage in the storage media of data representing the electronic data signal from the CPU 42 (e.g., the wager in the present example). As another example, the CPU 42 further, in accord with the execution of the stored instructions relating to the wagering game, causes the primary display 18, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of the stored instructions relating to the wagering game is further conducted in accord with a random outcome (e.g., determined by the RNG) that is used by the game-logic circuitry 40 to determine the outcome of the wagering-game instance. In at least some aspects, the game-logic circuitry 40 is configured to determine an outcome of the wagering-game instance at least partially in response to the random parameter. As can be seen from the description herein, the gaming machine 10 may be implemented with hardware and software architectures, circuitry, and other special features that differentiate it from general-purpose computers (e.g., desktop PCs, laptops, and tablets).

Traditionally, a gaming machine manufacturer may offer a discrete range of percentage variants for a given game. For example, a typical low-denomination game might offer the following percentage variants: 85%, 88%, 90%, 92%, 94%, and 96%. All of these percentage variants may be provided in discrete software variations, for example, in EPROMS or a flash memory image, only one of which may be installed in the gaming machine at a time. Alternately, the provided percentage variants may be included in a single game image. In the prior art, when the game is configured for use, either remotely by a central system or, more typically, using an operator configuration interface provided using, for example, the touchscreen 24 and buttons 26 of FIG. 2, the operator must choose a payback percentage from the discrete list offered. In such a case, no other percentage variants are available. However, the various embodiments of the present invention provide a new approach to how these percentage variants are created, selected, and configured. In accordance with a preferred embodiment, only two discrete percentage variants are provided in a game image, representing the highest and lowest percentage variants available. In the example above, these would be the 85% and 96% variants. Once a desired overall percentage is selected by the gaming machine operator, a weighted random mix of the two percentage variants is played to achieve the desired game yield.

In accordance with one or more embodiments, the following calculation method may be used to determine the weighting assigned to the lower percentage variant and higher percentage variant. Let D be the desired overall percentage. Let L be the lower of the two discrete percentage variants offered by the game, and let H be the higher of the two. In order to find the probabilities $P_L$ and $P_M$, which are the probabilities that the game plays the lower and higher percentage variants, respectively, we need to solve the following system of equations:

$$D=L\times P_L+H\times P_H$$

$$P_L+P_H=1$$

where $$L\leq D\leq H$$

Simple substitution yields the following results:

$$P_L=(H-D)/(H-L)$$

$$P_H=(D-L)/(H-L)$$

With probabilities $P_L$ and $P_H$, a weighted table, as shown in Table 1, may be generated. In this example, the total weight used is 1,000,000,000, but any other arbitrarily large number may be used as needed to achieve the desired precision.

TABLE 1

| Scenario | Probability | Weight |
|---|---|---|
| Player plays lower percentage variant | $P_L$ | 1,000,000,000 × $P_L$ |
| Player plays higher percentage variant | $P_H$ | 1,000,000,000 × $P_H$ |
| Total | 1.0000 | 1,000,000,000 |

It is important to note that this weighted table is calculated only once—at the time the game is configured. To change the weighted table, and thus the desired overall percentage, the game would need to be reconfigured, according to any jurisdictional regulations related to changes in payback percentage which may be in effect.

As the player plays the game, when a wager is initiated, the game first makes a random selection from the weighted table to determine which percentage variant will be played that game. If the weighted random selection dictates that the lower percentage variant is to be played, then the player will play the game using the reel strips and other weighted tables as defined in the mathematical model of the lower percentage variant. If the weighted random selection dictates that the higher percentage variant is to be played, then the player will play the game using the reel strips and other weighted tables as defined in the mathematical model of the higher percentage variant. In the long term, the combination of play of the lower percentage variant and the higher percentage variant, in the proportions determined by the weighted table above, will yield the desired overall return percentage or yield.

In accordance with one or more embodiments, certain differences exist between the lower percentage variant and the higher percentage variant. Game rules, pays, available bonus features, and other awards typically would not visibly change between percentage variants. All outcomes available in one percentage variant would be available in the other, and thus would also be available in any combination of the two. However, reel strips (both layout and/or weighting) and weighted tables used to determine the expected value of bonus features or other game outcomes vary from the lower percentage variant to the high percentage variant.

For example, in a slot machine game with mechanical reels, the printed reel strip artwork on each reel cannot be changed dynamically. However, virtual reel weights may be different between the two percentages, as is typically the case in discrete stepper game percentage variants. The reel layouts illustrated, in accordance with one or embodiments, in FIGS. 4A and 4B are from the lowest and highest available percentages, respectively, of a same example mechanical reel game.

The ordering of the symbols in the various "Symbol" columns of Tables 2 and 3 is the same between the two reel layouts. The only difference between the two percentage variants are the weights of the physical reel strips. The payback percentage for the game in Table 2 is 88.74%. The payback percentage for the game in Table 3 is 97.50%°. If the desired overall percentage is 90.25%, then the formulas above may be used to generate the weighted table shown in Table 4.

TABLE 3

| Scenario | Probability | Weight |
|---|---|---|
| Player plays 88.74% variant | 0.8276 | 827,625,571 |
| Player plays 97.50% variant | 0.1723 | 172,374,429 |
| Total | 1.0000 | 1,000,000,000 |

During game play, with each wager, a random selection is made from an internal table corresponding to the values shown in Table 4. If the selection is from 0 to 827,625,570, then the player will play a game using the 88.74% variant using the reel weights for that variant (Table 2). If the selection is from 827,625,571 to 999,999,999, the player will play a game using the 97.50% variant using the reel weights for that variant (Table 3). In this example, all other aspects of the game—namely, the pays for winning combinations, are held constant.

In a video game, or in a game with more complex features, there are several routes a game developer may take to create the two percentage variants. In accordance with one or more other embodiments, reel strip weights and layouts can change, as in the examples of FIGS. 5A and 5B.

The reel strips of FIG. 5A may generate an 85.74% variant, while the reel strips of FIG. 5B may generate a 96.23% variant. Note that both symbol ordering and weights have changed between the two sets of reel strips, but each symbol that appeared in some position on a given reel in the first variant still appears in some position on the same reel in the second variant—which is to say that all winning combinations available in the first variant are still available in the second variant; only the frequencies of those winning combinations has changed.

In accordance with still other embodiments, as illustrated by FIGS. 6A and 6B, the developer can change the weights in a weighted table in some bonus feature. Below is an example of a wheel feature in a game. To adjust the payback percentage, only the weights of the wheel were changed between FIG. 6A and FIG. 6B.

The feature wheel weights in FIG. 6A may result in an 85.23% variant, while the feature wheel weights in FIG. 6B may result in a 96.07% variant. Only certain weights have been changed in the second variant (FIG. 6B); all pays in FIG. 6A are still available and the values shown on the game's wheel remain unchanged.

Thus, in accordance with one or more embodiments, the different percentage variants would be created by changing reel strip weights or layouts in the base game or in the free games, or by changing the weights on weighted tables used to determine the outcomes of features or other aspects of the game. Pay values (such as those on the pay table, values on a wheel, etc.) do not change between percentage variants. The symbol set remains the same between percentages, as do any game rules or functionality. In general, the method avoids changing anything visible to the player, only the underlying mathematics that determines the distribution of pays changes from variant to variant.

In one embodiment, the gaming machine 10 and, additionally or alternatively, the external system 60 (e.g., a gaming server), means gaming equipment that meets the hardware and software requirements for fairness, security, and predictability as established by at least one state's gaming control board or commission. Prior to commercial deployment, the gaming machine 10, the external system 60, or both and the casino wagering game played thereon may need to satisfy minimum technical standards and require regulatory approval from a gaming control board or commission (e.g., the Nevada Gaming Commission, Alderney Gambling Control Commission, National Indian Gaming Commission, etc.) charged with regulating casino and other types of gaming in a defined geographical area, such as a state. By way of non-limiting example, a gaming machine in Nevada means a device as set forth in NRS 463.0155, 463.0191, and all other relevant provisions of the Nevada Gaming Control Act, and the gaming machine cannot be deployed for play in Nevada unless it meets the minimum standards set forth in, for example, Technical Standards 1 and 2 and Regulations 5 and 14 issued pursuant to the Nevada Gaming Control Act. Additionally, the gaming machine and the casino wagering game must be approved by the commission pursuant to various provisions in Regulation 14. Comparable statutes, regulations, and technical standards exist in other gaming jurisdictions.

Both the lower percentage variant and the higher percentage variant would individually meet all required payback, odds, and other regulations related to math design for a given jurisdiction. Because of this, any combination of the two percentage variants, as determined by the weighted table at the time of configuration, would also meet all of the same regulations.

Some specific, non-limiting examples of the types of regulations that are potentially related to the deployment of gaming machines incorporating one or more aspects of the invention are addressed below.

GLI Standard 3.3.7 Symbol Probability: "For game types (such as spinning reel games or video spinning reel games), unless otherwise denoted on the payglass, the mathematical probability of a symbol appearing in a position for any game outcome shall be constant." Because the probability of a symbol appearing in a position for any game outcome is constant in the lower percentage variant as well as in the higher percentage variant, individually, and because the weighted table that determines the probability of playing each of the percentage variants is defined at configuration and remains constant, the overall probability of a symbol appearing in a position for any game outcome, given the desired overall percentage configured, is also constant. Thus, this standard is met.

Nevada 14.040(2)(a): "Each possible permutation or combination of game elements which produce winning or losing game outcomes must be available for random selection at the initiation of each play." The percentage variants would be designed in such a way that the game rules, pays, available bonus features, and other awards would be the same in both variants. The concept of the present invention doesn't alter this—if each percentage variant satisfies this regulation individually, then any combination of the two would also satisfy this regulation.

Nevada 14.040(2)(b): "For gaming devices that are representative of live gambling games, the mathematical probability of a symbol or other element appearing in a game outcome must be equal to the mathematical probability of that symbol or element occurring in the live gambling game. For other gaming devices, the mathematical probability of a symbol appearing in a position in any game outcome must be constant." Because the probability of a symbol appearing in a position for any game outcome is constant in the lower percentage variant as well as in the higher percentage variant, individually, and because the weighted table that determines the probability of playing each of the percentage variants is defined at configuration and remains constant, the overall probability of a symbol appearing in a position for any game outcome, given the desired overall percentage configured, is also constant. Thus, this regulation is satisfied.

Nevada Technical Standard 2.010(1): "The theoretical payback percentage of a gaming device must not be capable of being changed without making a hardware or software change in the device except as provided for in Technical Standard 1. For purposes of this standard, the addition of an attendant-paid bonus, a progressive jackpot, or a change in rate of progression of an existing progressive jackpot is not considered to be a change in the theoretical payback of the gaming device." The weighted table that determines the probability of playing each of the percentage variants is calculated only once—at the time the game is configured. To change the weighted table, and thus the overall theoretical percentage, the game would need to be cleared and reconfigured, just as with any other change in payback percentage.

Nevada Technical Standard 2.040(1)(a)(2): "For multi-game and multi-denomination/multi-game gaming devices, provide the coin in information and the theoretical payback percentage, on a per paytable basis; and . . . " Because the game theme, game mechanics, symbol set, and paytable of both percentage variants remains the same, we do not consider this approach to percentage configuration to constitute a multi-game. We would anticipate that the game would be metered as any other single-game percentage variant.

Nevada Technical Standard 2.040(1)(a)(3): "For gaming devices which are considered slot machines and which contain paytables with a difference in theoretical payback percentage which exceeds 4 percent between wager categories, maintain and display coin in meters and the associated theoretical payback percentage, for each wager category with a different theoretical payback percentage, and calculate a weighted average theoretical payback percentage for that paytable." In accordance with various aspects of the invention, the theoretical payback percentage does not necessarily exceed 4% between wager categories. Because the two percentage variants are selected with pre-determined probability (as determined at configuration time), if the two variants do not have a percentage spread greater than 4%, then the overall theoretical percentage will also not have a percentage spread greater than 4%, and special wager category metering is not required.

New Jersey 13:69E-1.28A(b): "Except as otherwise provided in this section, all winning combinations used in achieving the minimum theoretical RTP for each slot machine game shall be available on each play that requires a wager." The percentage variants would be designed in such a way that the game rules, pays, available bonus features, and other awards would be the same in both variants. The concepts of the present invention do not alter this—if each percentage variant satisfies this regulation individually, then any combination of the two also satisfies this regulation.

New Jersey 13:69E-1.28A(o): "Gaming devices that allow a patron to select from two or more game themes must be capable of displaying the following: a clear indication of which game has been selected for play; and a clear description of the rules governing the game selected." Because the game theme, game mechanics, symbol set, and pay table of both percentage variants remains the same, we do not consider this approach to percentage configuration to constitute a multi-game. Further, the operator selects the desired overall payback percentage at configuration time; no patron selection is involved.

Ontario 2.1.5—"Each award shown on the pay table must be attainable: The percentage variants would be designed in such a way that the game rules, pays, available bonus features, and other awards would be the same in both variants." The method of the present invention does not doesn't alter this—if each percentage variant satisfies this regulation individually, then any combination of the two would also satisfy this regulation.

Ontario 2.1.9—"Any games which change the conditions of play during game play (e.g. number of decks in card games, reels in a slot game) must alert the player of the change. In the case of a reel game where reel strip weightings are changed due to different wagering options being selected or during free or bonus spins, the gaming equipment must clearly state in the help screens that different reels are used for the particular game states and/or wagering options; and: alter the appearance of the reels (i.e. change the appearance of the symbol, change the background color of the reel strip); or display on the game screen that reels have changed, and/or different reels are in play." Because the theoretical payback percentage is fixed at configuration, the conditions of play are not being changed during game play. Further, the percentage variant is independent of wagering option. Thus, the appearance of the reels should not need to be altered during gameplay, nor does any display need to indicate that different reels are in play as the game transitions between percentage variants.

Ontario 14.1.5—"The gaming equipment must not automatically alter paytables or any function of the equipment based on internal computation of the hold percentage or the playing history." Because the theoretical payback percentage is fixed at configuration, and because the mathematical details of each percentage variant is fixed at design time, the random selection of the percentage variant is not based on any history-based computation of the hold percentage. It is believed that the method of the present invention fully satisfies this regulation.

Missouri 11 CSR 45-5.190(4)(L)—"Have available for random selection at the initiation of each play, each possible permutation or combination of game elements which produce winning or losing game outcomes; and . . . ". The percentage variants would be designed in such a way that the game rules, pays, available bonus features, and other awards would be the same in both variants. The method of the present invention does not alter this—if each percentage variant satisfies this regulation individually, then any combination of the two would also satisfy this regulation.

Missouri 11 CSR 45-5.190(4)(M)—"Not automatically alter pay-tables or any function of the electronic gaming device based on internal computation of the hold percentage." Because the theoretical payback percentage is fixed at configuration, and because the mathematical details of each percentage variant is fixed at design time, the random selection of the percentage variant is not based on any history-based computation of the hold percentage. The method of the present invention fully satisfies this regulation.

Figure 7:
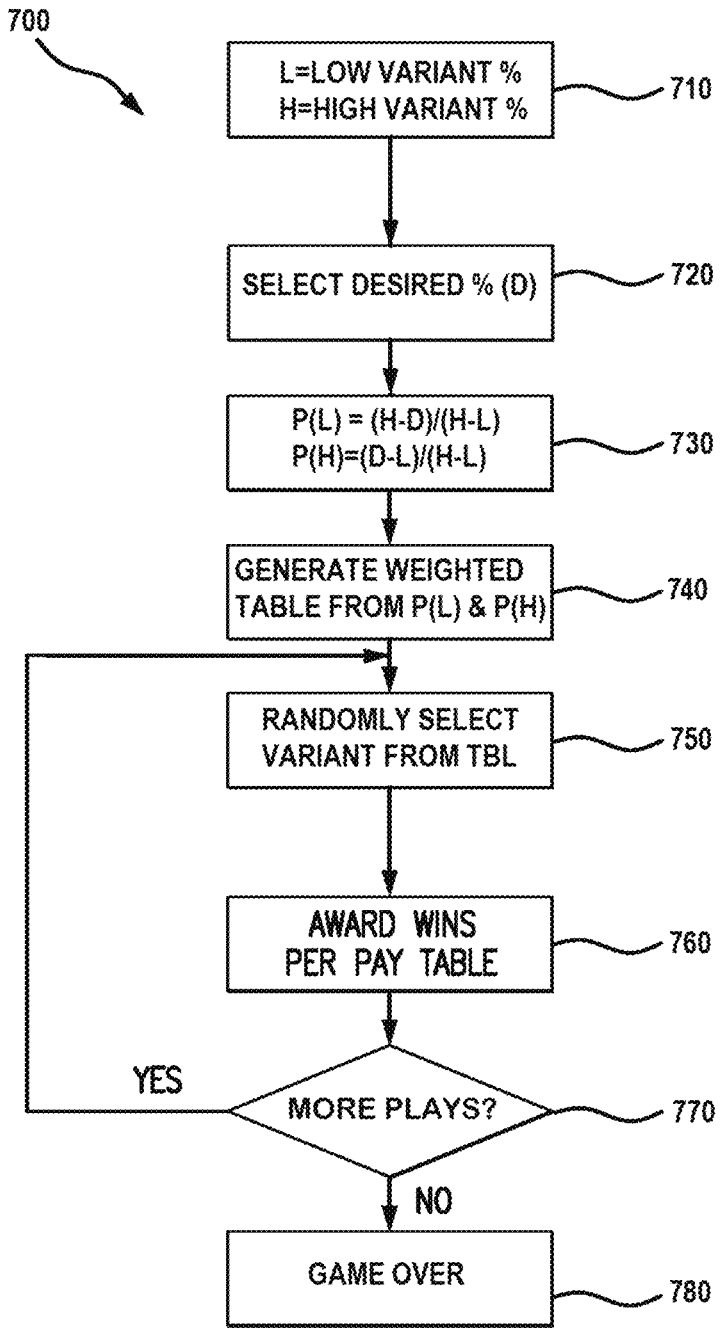
FIG. 7 is a flowchart for an algorithm that corresponds to instructions executed by a controller in accord with at least some aspects of the disclosed concepts.

FIG. 7, in accordance with one or more embodiments, represents one algorithm 700 that corresponds to at least some instructions stored and executed by the game-logic circuitry 40 in FIG. 2 to perform the above described functions associated with the disclosed concepts.

The order of actions as shown in FIG. 7 is only illustrative, and should not be considered limiting. For example, the order of the actions may be changed, additional steps may be added or some steps may be removed without deviating from the scope and spirit of the invention. In a further example, while the above algorithm is described within the context of a bonus game, it is equally contemplated that the invention can be practiced within the context of the basic wagering game.

At step 710, a low percentage variant mathematical model L of the game and a high percentage variant mathematical model H of the game are provided. At step 720, a user (typically the game operator, such as a casino), selects a desired yield percentage D that falls inclusively between L and H. At step 730, the probabilities of selecting either the L variant or the H variant during game play are calculated according to the formulas $P_L=(H-D)/(H-L)$ and $P_H=(D-L)/(H-L)$. At step 740, a weighted table is generated using the values of $P_L$ and $P_H$ as described in the example above. At step 750, subsequent to a player initiating play of the game, one of the two variants is randomly selected from the weighted table and the game is played according to that variant, with any wins awarded per the pay table at step 760. At decision 770, if another game has been initiated, processing returns to step 750, where another random selection from the weighted table determines the variant (H or L) to be used for the next game. If no additional game play is desired, the game ends at step 780. Should a new player wish to play, since the weighted table has already been determined, the method would resume at step 750. If there is a desire by the operator to reconfigure the desired yield percentage, the method would start again at step 720.

Each of these embodiments and obvious variations thereof is contemplated as falling within the spirit and scope of the claimed invention, which is set forth in the following claims. Moreover, the present concepts expressly include any and all combinations and sub-combinations of the preceding elements and aspects.

What is claimed is:

1. A gaming system, comprising:

a regulated gaming machine primarily dedicated for use in playing at least one regulated casino wagering game, the gaming machine including an electronic display device, one or more electronic input devices, a value input device; and game-logic circuitry configured to:

provide a low variant mathematical model of the casino wagering game providing a first yield percentage and a high variant mathematical model of the casino wagering game providing a second yield percentage greater than the first yield percentage;

accept an input indicative of a desired yield percentage between the first yield percentage and the second yield percentage, inclusive;

based on the first yield percentage, the second yield percentage and the desired yield percentage, compute relative probabilities of selecting the low variant mathematical model and the high variant mathematical model for a given play of the casino wagering game and generate a weighted table based on the relative probabilities;

detect, via the value input device, a physical item associated with a monetary value that establishes a credit balance;

receive, via at least one of the one or more electronic input devices, an input indicative of a wager covered by the credit balance;

randomly select an entry from the weighted table to determine whether the low variant mathematical model or the high variant mathematical model will be used for the current play of the casino wagering game;

randomly select an outcome of the casino wagering game based in part on the determined mathematical model;

direct the electronic display device to display the selected outcome;

award an award in response to the displayed outcome meeting a predetermined award criterion; and receive, via at least one of the one or more electronic input devices, a cashout input that initiates a payout from the credit balance.

2. The gaming system of claim 1 wherein the probability of selecting the low variant mathematical model for the current play of the casino wagering game is determined by the formula (H−D)/(H−L), wherein H is the yield percentage of the high variant mathematical model, L is the yield percentage of the low variant mathematical model and D represents the desired yield percentage.

3. The gaming system of claim 1 wherein the probability of selecting the high variant mathematical model for the current play of the casino wagering game is determined by the formula (D−L)/(H−L), wherein H is the yield percentage of the high variant mathematical model, L is the yield percentage of the low variant mathematical model and D represents the desired yield percentage.

4. The gaming system of claim 1 wherein low variant mathematical model and the high variant mathematical model are produced by altering weights of symbols on reel strips associated with the casino wagering game.

5. The gaming system of claim 1 wherein the low variant mathematical model and the high variant mathematical model are produced by altering layouts of symbols on reel strips associated with the casino wagering game.

6. The gaming system of claim 1 wherein the low variant mathematical model and the high variant mathematical model are produced by altering weights and layouts of symbols on reel strips associated with the casino wagering game.

7. The gaming system of claim 1 wherein the low variant mathematical model and the high variant mathematical model are produced by altering weights of segments on a wheel associated with the casino wagering game.

8. A regulated gaming machine primarily dedicated for use in playing at least one regulated casino wagering game, the gaming machine comprising an electronic display device, one or more electronic input devices, a value input device; and game-logic circuitry configured to:

provide a low variant mathematical model of the casino wagering game providing a first yield percentage and a high variant mathematical model of the casino wagering game providing a second yield percentage greater than the first yield percentage;

accept an input indicative of a desired yield percentage between the first yield percentage and the second yield percentage, inclusive;

based on the first yield percentage, the second yield percentage and the desired yield percentage, compute relative probabilities of selecting the low variant mathematical model and the high variant mathematical model for a given play of the casino wagering game and generate a weighted table based on the relative probabilities;

detect, via the value input device, a physical item associated with a monetary value that establishes a credit balance;

receive, via at least one of the one or more electronic input devices, an input indicative of a wager covered by the credit balance;

randomly select an entry from the weighted table to determine whether the low variant mathematical model or the high variant mathematical model will be used for the current play of the casino wagering game;

randomly select an outcome of the casino wagering game based in part on the determined mathematical model;

direct the electronic display device to display the selected outcome; and award an award in response to the displayed outcome meeting a predetermined award criterion; and receive, via at least one of the one or more electronic input devices, a cashout input that initiates a payout from the credit balance.

9. The gaming machine of claim 8 wherein the probability of selecting the low variant mathematical model for the current play of the casino wagering game is determined by the formula (H−D)/(H−L), wherein H is the yield percentage of the high variant mathematical model, L is the yield percentage of the low variant mathematical model and D represents the desired yield percentage.

10. The gaming machine of claim 8 wherein the probability of selecting the high variant mathematical model for the current play of the casino wagering game is determined by the formula (D−L)/(H−L), wherein H is the yield percentage of the high variant mathematical model, L is the yield percentage of the low variant mathematical model and D represents the desired yield percentage.

11. The gaming machine of claim 8 wherein low variant mathematical model and the high variant mathematical model are produced by altering weights of symbols on reel strips associated with the casino wagering game.

12. The gaming machine of claim 8 wherein the low variant mathematical model and the high variant mathematical model are produced by altering layouts of symbols on reel strips associated with the casino wagering game.

13. The gaming machine of claim 8 wherein the low variant mathematical model and the high variant mathematical model are produced by altering weights and layouts of symbols on reel strips associated with the casino wagering game.

14. The gaming machine of claim 8 wherein the low variant mathematical model and the high variant mathematical model are produced by altering weights of segments on a wheel associated with the casino wagering game.

15. A method of operating a gaming system, the gaming system including game-logic circuitry and a regulated gaming machine, the gaming machine primarily dedicated to playing at least one casino wagering game, the gaming machine including an electronic display device, one or more electronic input devices and a value input device, the method comprising:

providing a low variant mathematical model of the casino wagering game providing a first yield percentage and a high variant mathematical model of the casino wagering game providing a second yield percentage greater than the first yield percentage;

accepting an input indicative of a desired yield percentage between the first yield percentage and the second yield percentage, inclusive;

based on the first yield percentage, the second yield percentage and the desired yield percentage, computing relative probabilities of selecting the low variant mathematical model and the high variant mathematical model for a given play of the casino wagering game and generating a weighted table based on the relative probabilities;

detecting, via the value input device, a physical item associated with a monetary value that establishes a credit balance;

receiving via at least one of the one or more electronic input devices, an input indicative of a wager covered by the credit balance;

randomly selecting an entry from the weighted table to determine whether the low variant mathematical model or the high variant mathematical model will be used for the current play of the casino wagering game;

randomly selecting an outcome of the casino wagering game based in part on the determined mathematical model;

directing the electronic display device to display the selected outcome;

awarding an award in response to the displayed outcome meeting a predetermined award criterion; and receiving, via at least one of the one or more electronic input devices, a cashout input that initiates a payout from the credit balance.

16. The method of claim 15 wherein the probability of selecting the low variant mathematical model for the current play of the casino wagering game is determined by the formula (H−D)/(H−L), wherein H is the yield percentage of the high variant mathematical model, L is the yield percentage of the low variant mathematical model and D represents the desired yield percentage.

17. The method of claim 15 wherein the probability of selecting the high variant mathematical model for the current play of the casino wagering game is determined by the formula (D−L)/(H−L), wherein H is the yield percentage of the high variant mathematical model, L is the yield percentage of the low variant mathematical model and D represents the desired yield percentage.

18. The method of claim 15 wherein low variant mathematical model and the high variant mathematical model are produced by altering weights of symbols on reel strips associated with the casino wagering game.

19. The method of claim 15 wherein the low variant mathematical model and the high variant mathematical model are produced by altering layouts of symbols on reel strips associated with the casino wagering game.

20. The method of claim 15 wherein the low variant mathematical model and the high variant mathematical model are produced by altering weights and layouts of symbols on reel strips associated with the casino wagering game.

* * * * *